US006730234B2

(12) United States Patent
Symens et al.

(10) Patent No.: US 6,730,234 B2
(45) Date of Patent: May 4, 2004

(54) METHOD FOR REGENERATION OF USED HALIDE FLUIDS

(75) Inventors: Raymond D. Symens, The Woodlands, TX (US); Lyle H. Howard, West Memphis, AR (US); Thomas William Polkinghorn, The Woodlands, TX (US); Surendra Kumar Mishra, The Woodlands, TX (US)

(73) Assignee: Tetra Technologies, Inc., The Woodlands, TX (US)

( * ) Notice: Subject to any disclaimer, the term of this patent is extended or adjusted under 35 U.S.C. 154(b) by 246 days.

(21) Appl. No.: 10/097,799

(22) Filed: Mar. 14, 2002

(65) Prior Publication Data

US 2002/0130090 A1 Sep. 19, 2002

Related U.S. Application Data

(60) Provisional application No. 60/276,172, filed on Mar. 15, 2001.

(51) Int. Cl.[7] ..... C01F 11/20; C01B 9/00

(52) U.S. Cl. ..... 210/753; 210/757; 210/758; 210/767; 423/491

(58) Field of Search ..... 210/749, 753, 210/754–756, 757, 758, 766, 767, 787, 800; 423/491, 493, 497; 166/265, 267; 175/65, 66

(56) References Cited

U.S. PATENT DOCUMENTS

| | | | | | |
|---|---|---|---|---|---|
| 4,083,942 | A | * | 4/1978 | Sanders | 423/497 |
| 4,207,152 | A | * | 6/1980 | Kadija et al. | 205/536 |
| 4,234,556 | A | * | 11/1980 | del Valle | 423/497 |
| 4,405,465 | A | * | 9/1983 | Moore et al. | 210/757 |
| 4,451,377 | A | * | 5/1984 | Luxemburg | 210/708 |
| 4,548,720 | A | * | 10/1985 | Gilligan, III | 507/140 |
| 4,592,425 | A | * | 6/1986 | Oliver et al. | 166/312 |
| 5,145,515 | A | * | 9/1992 | Gallup et al. | 75/712 |
| 5,230,879 | A | * | 7/1993 | Beaver et al. | 423/491 |
| 6,036,870 | A | * | 3/2000 | Briant et al. | 210/781 |
| 6,036,937 | A | * | 3/2000 | Dunaway et al. | 423/491 |

* cited by examiner

*Primary Examiner*—Frank M. Lawrence
(74) *Attorney, Agent, or Firm*—D'Ambrosio & Associates, PLLC

(57) ABSTRACT

A method for regenerating a used halide fluid comprising a density greater than 9.0 lbs/gal. and containing both soluble and insoluble impurities. This method comprises the steps of (1) adding acid to the used halide fluid so that the pH is within a range of approximately 0 to 10.0; (2) contacting the used halide fluid with halogen to increase the density to at least 10.0 lbs./gal., adjust the desired true crystallization temperature of the fluid and oxidize soluble impurities; (3) adding a reducing agent while maintaining the temperature at a minimum of 10° C.; (4) contacting the fluid with an alkali to neutralize excess acid; and (5) separating any suspended solid impurities from the fluid.

46 Claims, 1 Drawing Sheet

FIGURE
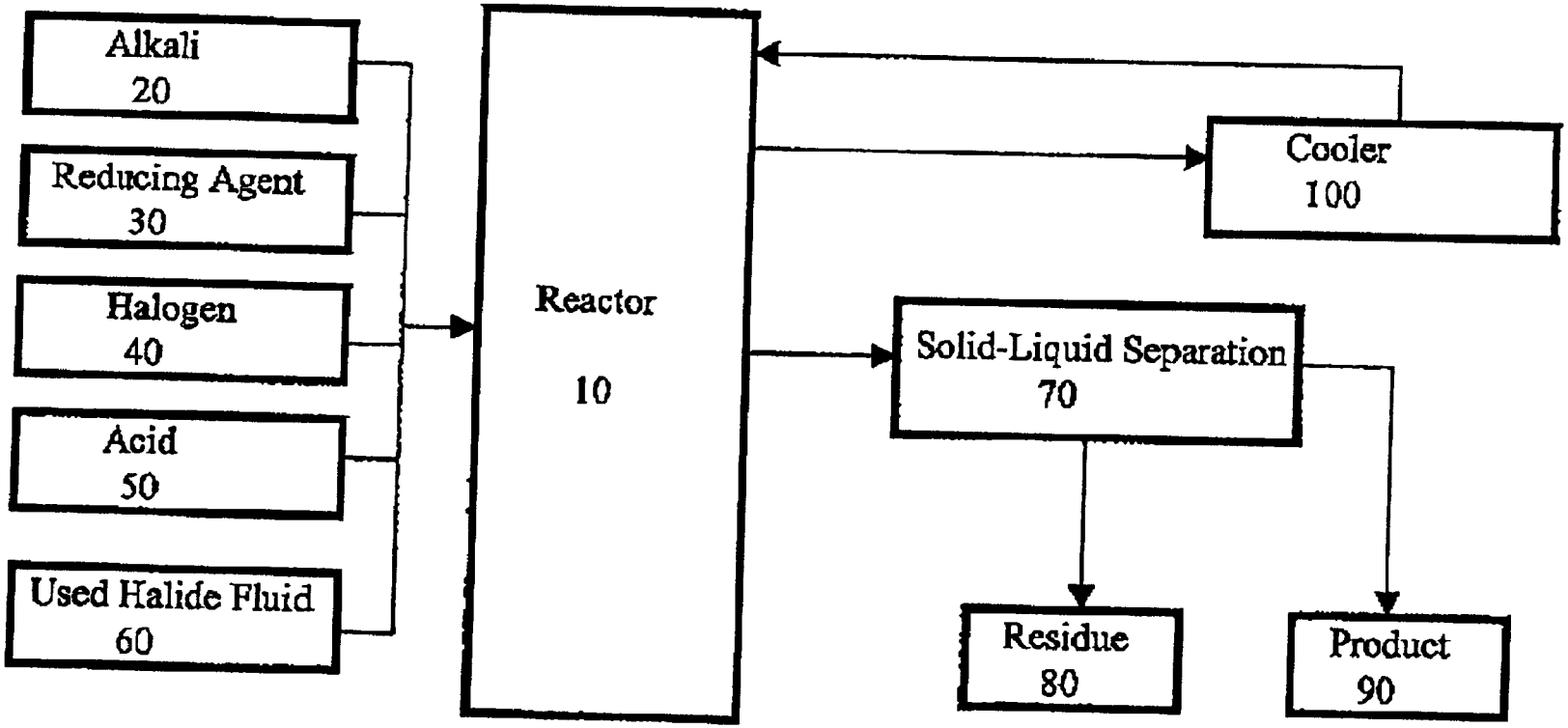

METHOD FOR REGENERATION OF USED HALIDE FLUIDS

CROSS REFERENCES TO RELATED CASES

This application claims priority to U.S. Provisional Patent Application, Ser. No. 60/276,172 filed Mar. 15, 2001, now abandoned.

FIELD OF THE INVENTION

The present invention relates to a method for regenerating used halide fluids. More specifically the invention relates to enhancing used halide fluids by removing impurities, increasing the density of the halide fluid, and increasing the concentration of electrolytes and adjusting the true crystallization temperature of the fluid.

BACKGROUND OF THE INVENTION

Clear brine fluids used in deep oil and gas wells or other industrial and agricultural processes become diluted due to the increased concentration of water in the system. In addition, these fluids can become contaminated with impurities such as metallic cations, hydrocarbons and organic polymers. At some point, the overall quality of the brine, density and true crystallization temperature (TCT) in particular, changes to a level that does not conform to product specifications.

Brine fluids are expensive to produce. Due to the high amounts of chlorides, bromides and, in some brines, zinc that are present in the used fluids, the disposal of used clear brine fluids is also very costly. It is highly desirable that a used halide fluid be recuperated, regenerated and recycled back into operation.

The current industrial practice for the treatment of recuperated used brines from oil and gas wells involves introduction of additional electrolyte of the fluid composition to adjust the density and the resulting TCT of the brine to the desired level. The process of adding liquid electrolyte to the used brine necessarily introduces even more water into the system. Dissolving a solid electrolyte, calcium chloride for example, is a slow and tedious process that may also require the addition of more water to the brine. Solid electrolytes are also very costly thereby making this method expensive. Another significant disadvantage of the currently utilized method in the industry is that some electrolytes are pH sensitive and can be easily lost due to precipitation. For example, the zinc ions from a brine containing zinc bromide or zinc chloride will start precipitating as zinc hydroxide at a slightly acidic or alkaline pH. As a result, the density of the solution that is being regenerated will drop substantially. The change in the density also changes the TCT of the fluid, so that the fluid is unable to meet the specification set by the needs of the oil field for TCT value of the fluid. Using the methods of evaporation or blending to increase density or to adjust the TCT is time consuming, expensive and difficult to control.

Oliver et al., U.S. Pat. No. 4,592,425, discloses a process for removal of small amounts of settled solids, i.e. drilling residue, mud, solids and oil, from the brine at the production zone of interest without reprocessing the entire volume of brine within the well bore. The settled solids are spotted (treated) in a mixture of an aliphatic alcohol with between 5 and 14 carbon atoms and a surfactant with a molecular weight in a range from about 150 to 500 with predominantly hydrophobic characteristics. The surfactant is selected from the group consisting of aliphatic amines, amides and aliphatic amine oxides with an alkyl group between 8 and 18 carbon atoms. The amount of both the alcohol and the surfactant must be empirically determined for each application. Upon spotting in the solids with the aliphatic alcohol-surfactant mixture, the solids become buoyant in the brine and rise to the to the top of the well bore thus leaving the well production zone with clean, solids-free brine.

Gilligan III, U.S. Pat. No. 4,548,720, discloses a process for scavenging hydrogen sulfide from drilling fluids by adding solid oxidants, such as potassium permanganate, sodium perforate, potassium peroxidisulfate and calcium hypochlorate. These oxidants dissolve in the drilling fluid and convert hydrogen sulfide into free sulfur and innocuous sulfur by-products.

Luxemburg, U.S. Pat. No. 4,451,377, discloses a process for cleaning oil-contaminated well bore fluids containing particulate drill cutting solids by admixing the fluid with an aqueous polymeric solution and diatomaceous earth, and then filtering the admixture. Kadija et al., U.S. Pat. No. 4,207,152, discloses a process for removing cationic contaminants from alkali metal chloride brines used in electrolytic processes such as the production of chlorine and alkali metal hydroxides or alkali metal chlorates. The alkali metal chloride brine is treated with solid particles of magnesium-containing silicate.

What is needed is a method that allows for an efficient regeneration of the recuperated used brine fluid in a controlled manner. A method that removes metallic cationic impurities and avoids both precipitation and conditions that increase dilution and adversely affect the TCT of the fluid by addition of water into the recuperated brine fluid is also desirable.

SUMMARY OF THE INVENTION

The present invention relates to an innovative method for regeneration of used halide fluids that have been recuperated from industrial processes such as oil and gas drilling, agricultural chemical processes, metal plating or water treatment. Used halide fluids, bromide or chloride brines for example, are usually contaminated with soluble and insoluble impurities. For example, during well operation procedures, because of the continuous contact with water, these recuperated, used fluids typically have a density greater than 9.0 lbs/gal but less than the required density of a desired drilling fluid. To remove impurities, increase the density, adjust the resulting TCT and enhance the concentration of electrolytes, one preferred method of regeneration of a used halide fluid comprising soluble and insoluble impurities and having a density greater than 9.0 lbs/gal comprises adding an acid to the used halide fluid. The used halide fluid is then contacted with a halogen, bromine for example, to increase fluid density and oxidize impurities. Alternatively, a halogen-generating species, such as oxyhalogen salts, hypochloride, hypobromide and the like can be used to increase density, adjust TCT and oxidize impurities. The used halide fluid, if comprising a high solid content, should be filtered to remove the solids prior to acidification.

A reducing agent can be added to convert halogen to halide ion while maintaining the temperature at a minimum of 10° C. Preferably, the fluid is then contacted with an alkali to neutralize any excess acid. Any suspended solid impurities remaining can be separated from the fluid. During the method, it is preferred that if the metallic cations are from a base metal group, the pH can be maintained within a range of approximately 0.0 to 5.5. For the alkali and alkali earth metal cations this range can be from 0.0 to 10.0. The acid used for acidification can comprise hydrobromic acid. Alternatively the acid can comprise hydrochloric acid or an organic acid. The reducing agent is preferably selected from a group consisting of ammonia, sulfur, hydrogen sulfide, sodium bisulfide, metallic zinc, metallic iron, metallic copper, metallic nickel, metallic cadmium, metallic cobalt, metallic aluminum, metallic chromium, metallic manganese, organic acids, alcohols and aldehydes.

In one aspect, the electrolyte to be enhanced in the used fluid is salt of alkali metal, an alkali earth metal or a base metal. If the alkali earth metal is calcium, the alkali used to neutralize excess acid can be calcium hydroxide or calcium oxide. Alternatively, if the alkali earth metal in the used fluid is strontium, the alkali used to neutralize excess acid is preferably strontium hydroxide or strontium oxide.

In another preferred method, the alkali used to neutralize excess acid is an alkali metal hydroxide, sodium hydroxide or potassium hydroxide for example. Ammonia can also be used to neutralize excess acid.

In another preferred method the alkali used to neutralize excess acid is a base metal hydroxide or base metal oxide, such as zinc hydroxide, zinc oxide, copper hydroxide or copper oxide.

In another preferred method, the alkali used to neutralize excess acid is aluminum hydroxide or aluminum oxide, manganese hydroxide or manganese oxide, chromium hydroxide or chromium oxide.

One embodiment of the method for regeneration of used halide fluids comprising soluble and insoluble impurities comprises the steps of:

a) determining density of the used halide fluid;
b) analyzing chemical composition, the suspended solids content and the oil and grease content of the used halide fluid;
c) separating the suspended solids and oil and grease from the used halide fluid;
d) adding acid to the used halide fluid;
e) contacting the used halide fluid with halogen or halogen-generating species to increase fluid density and oxidize impurities;
f) adding a reducing agent while maintaining the temperature at a minimum of 10° C.;
g) contacting the fluid with an alkali to neutralize excess acid;
h) separating any suspended solid impurities from the fluid.

In one preferred embodiment, the recuperated used halide fluid is piped into a reactor after density and chemical composition have been determined according to steps (a) and (b). In one aspect of the practice of this invention, the acid, halogen, reducing agent and alkali can be piped into reactor along with the fluid. Alternatively, the acid, halogen, reducing agent and alkali can be transported separately to the reactor. Bromine is one preferred halogen used in regeneration.

Another preferred method regenerates a used halide fluid comprising a blend of a group of halide salts, such as calcium chloride, calcium bromide, zinc bromide or a combination thereof. The starting brine fluid will typically have a density greater than 9.0 lbs/gal. and contain both soluble and insoluble impurities. This method comprises the steps of (1) adding acid to the used halide fluid so that the pH is within a range of approximately 0.0 to 5.5 for a base metal or 0 to 10.0 for alkali and alkali earth metal systems; (2) contacting the used halide fluid with bromine to increase the density to at least 10.0 lbs./gal. and oxidize soluble impurities; (3) adding a reducing agent while maintaining the temperature at a minimum of 10° C.; (4) contacting the fluid with an alkali to neutralize excess acid; and (5) separating any suspended solid impurities from the fluid.

BRIEF DESCRIPTION OF THE DRAWINGS

The FIGURE is a schematic of one embodiment of the method of the invention.

DETAILED DESCRIPTION OF INVENTION

The present invention relates to an innovative method for regeneration of used halide fluids. Typically, the used halide fluids, calcium or zinc brine for example, have been recuperated from industrial processes such as oil and gas drilling, agricultural chemical processes, metal plating or water treatment. The recuperated halides often contain soluble and insoluble impurities and can be so diluted that the density of the halides and concentrations of the electrolytes are not acceptable for continued industrial operations.

For the purpose of illustration, reference hereafter is made, for convenience, to brine fluids used in oil and gas drilling without limiting the scope of the invention. Clear brine fluids used in deep oil and gas wells become diluted due to the increased concentration of water in the operations system. Additionally, they become contaminated with impurities such as metallic cations, hydrocarbons such as oils, as well as organic polymers, solids, muds and sands. As a result, the overall quality of the brine fluid is reduced; the density in particular drops, and the true crystallization temperature (TCT) changes to a level that does not conform to product specifications. Brine fluids are expensive to produce. Also, due to the hazardously high amounts of chlorides, bromides and zinc present in brine fluids, the disposal of used clear brine fluids can be very costly. Regeneration of the used fluids by the method of this invention is performed in a controlled manner so that the regenerated brine can economically be recycled back into the systems.

In the practice of one embodiment of this invention according to the FIGURE, a used halide fluid 60, such as a drilling fluid, can comprise a density above water, 9.0 lbs/gal for example, but not high enough to perform during the drilling operations, especially in deeper or higher pressure wells. For use in well operations, a halide fluid has a specific density targeted to the type of drilling operation and/or pressure of the well. Clear brines used as completion, workover and drilling fluids comprise a density higher than the density of water, 8.3 lbs/gal, typically within a range of approximately 11.4 lbs/gal to 16 lbs/gal, and even possibly as high as 23.0 lbs/gal depending on the targeted use of the brine. Electrolytes of alkali metals, alkali earth metals and base metals are commonly used in the composition of these brine fluids and are often selected according to their ability to increase the density of the drilling fluid. During the method of this invention, the density of the used drilling fluids is restored to a density that is necessary for well operations thereby regenerating the fluid to its useful state. The practice of this invention also allows for the adjustment of the true crystallization temperature (TCT) of the fluid. TCT is a function of the density. During oil and gas operations, the operator of the production wells checks the specifications for the TCT of the electrolytes within the fluids being used. These substrates adversely affect the properties of the fluid that are desirable for the oil and gas industries.

The FIGURE illustrates used fluid 60 piped into a reactor 10. The composition and density of the used halide fluid 60 determines the parameters of the method of the reaction. Knowledge of this composition and the properties of the fluid, i.e., electrolytes present, initial pH, density, and impurities present, is critical to determine the procedure and chemicals used during the method. The electrolytes present in the recuperated, used halide fluid 60 can comprise an alkali metal, alkali earth metal or a base metal salt These salts can be selected from a group of salts comprising sodium chloride, calcium chloride, zinc chloride, sodium bromide, calcium bromide, zinc bromide or blends thereof can be employed. Strontium chloride, strontium bromide, copper chloride, copper bromide, nickel chloride, nickel bromide, aluminum chloride or aluminum bromide can also be considered.

A used brine fluid 60 often comprises a blend of any of these metal salts, calcium chloride, calcium bromide and/or zinc bromide for example. In one embodiment metal present in the recuperated used halide can comprise zinc, copper cobalt, cadmium, nickel, potassium, cesium, lithium, barium, magnesium, aluminum, manganese, chromium or combinations thereof. The halide ions present can comprise bromide or chloride as illustrated above, but iodide ions are also within the scope of this invention. The manner in which these various electrolytes are blended depends largely on the density and crystallization temperature requirements for the particular brine fluid needed. A double or triple electrolyte blend can be used to obtain a higher density clear brine fluid. When blending a relatively high-density clear brine fluid, bromide electrolytes provide higher flexibility than the relatively low-density chloride electrolytes. In addition, the stability and TCT of the blended finished product also depends on the proportion of the individual electrolytes in the composition. For example, brine fluids with a high concentration of calcium chloride may precipitate carbonates or sulfates, which are often present in formation waters of oil or gas wells. Zinc bromide brines, on the other hand, can be used to provide high density, calcium-free brine fluids which do not precipitate anions such as carbonates and sulfates due to the acidic nature of the zinc ion. Such zinc bromide brines can also be used to adjust the TCT of the fluid.

During the regeneration of used halide fluids, the density and TCT of the brine fluid can be adjusted by altering the concentration of the electrolyte or electrolytes in the solution. The parameters, acidity, temperature etc., of the method must be adjusted during the regeneration to encompass the blend of electrolytes present. The used halide fluids should be analyzed and evaluated for their solids content. Preferably, the solids are removed by a solid-liquid separation method known in the art prior to the treatment of the fluids within the reactor 10. High solid content in the feed to the reactor 10 can result in increased undesirable impurities in the finished product and will also affect other properties of the fluids.

During one method for regenerating used halide fluids, the initial used halide fluid 60 piped into the reactor 10 is a fluid that was diluted during well operations and can comprise soluble and insoluble impurities such as metallic cations, hydrocarbons, polymers, suspended solids, drill cuttings and sand or grit. Because of dilution by contact with waters found in wells, these used fluids typically have less than the desired density of the required drilling fluid, but a density greater than 9.0 lbs/gal. The used halide fluid, if comprising a high solid content, should be filtered to remove the solids prior to acidification. The method operates more efficiently if oil and grease residues and other solids are removed prior to the process. A separation process prior to acidification can remove oil and grease. The separation process can include destabilization of the emulsified oil followed by physical separation of the oily phase by a suitable process known in the art.

One primary purpose of regenerating used halide fluids according to the method of this invention is to replace the electrolytes lost during well operations or industrial use of the fluid. In one preferred method, prior to addition of the chemicals to restore the electrolyte content of the used halide fluid, the initial density of the recuperated halide fluid is calculated and the chemical composition analyzed. After analysis, the selection and amount of the proper alkali used to neutralize excess acid and restore lost electrolytes can be made. If the recuperated halide fluid is calcium chloride, for example, calcium oxide can be used to neutralize excess acid thereby restoring calcium ions.

In one preferred method of the practice of this invention, adding acid 50 to the used halide fluid 60 acidifies the fluid. The composition of the initial used halide fluid 60 can comprise aqueous zinc bromide or aqueous calcium bromide. Alternatively, a blend of chlorides and bromides of calcium and zinc in various proportions can be used. For example, aqueous zinc bromide and calcium bromide, zinc bromide and calcium chloride or zinc chloride and calcium bromide. Acidification is required to avoid precipitation of the metallic salts, particularly where zinc and calcium are present. If the used halide comprises base metals, a pH within a range of 0 to 6, preferably 0 to 5.5, is therefore preferred. If the used halide comprises alkali or alkali earth metals, a pH within a range of 0 to 10, is preferred. The acid 50 used for acidification can comprise hydrobromic acid. Alternatively the acid can comprise hydrochloric acid or an organic acid.

The used halide fluid is then contacted with bromine. Bromine is effective to increase fluid density, adjust true crystallization temperature and removes or destroys impurities. Impurities can comprise metallic cations, hydrocarbons or polymers. Alternatively, the used halide fluid can be contacted with a bromine-generating species.

The addition of bromine enhances the bromide ions available in the fluid so as to return the used halide fluid to the desired density for it's specific use. Bromine also functions to oxidize impurities such as metallic cations, and the polymers and hydrocarbons found in the used fluid. If polymers are present, which is usually the case since various polymers are used as viscosifiers, oxidation is necessary to destroy these polymers. If the used brine is not viscosified, however, acidification is not necessary to oxidize the polymer. That step can be eliminated so that the process next comprises the addition of a halogen.

Unlike peroxides, bromine does not increase the pH of the fluids that can promote unwanted precipitation of the metals. Compared to peroxides, bromine increases the density of the fluid rather than reducing it. Preferably the bromine is added while maintaining the temperature at a minimum of 10° C., especially when adding bromine to a blend of used halides. A cooler 100 can be used to contol the rate of the reaction by maintaining the desired reaction temperature. In another preferred embodiment, the temperature is maintained at a minimum of 20° C. With the addition of bromine, the resulting TCT can be adjusted to avoid the precipitation of electrolytes, which can reduce the density of the fluid.

A reducing agent 30 can be added in a controlled manner to combine with and remove excess bromine. Preferably the addition of the reducing agent is controlled by maintaining the temperature at a minimum of approximately 10° C. The reducing agent is preferably selected from a group consisting of ammonia, sulfur, hydrogen sulfide, sodium bisulfide, metallic zinc, metallic iron, metallic copper, metallic nickel, metallic cadmium, metallic cobalt, metallic aluminum, metallic manganese, metallic chromium, organic acids, alcohols and aldehydes.

In a further step of this method, the fluid is preferably contacted with an alkali 20 to neutralize any excess acid. In one aspect, a base metal, an alkali metal and an alkali earth metal can be present in the used fluid. The composition and density of the base metal is determined prior to the halide fluid 60 entering the reactor 10. To regenerate the used halide fluid, the metal ion concentration must be restored to adjust the density required for the useful function of the halide brine in the well. In one embodiment, the alkali earth metal in the recuperated halide fluid is calcium, in this embodiment, the alkali used to neutralize excess acid can be calcium hydroxide or calcium oxide. Alternatively, if the alkali earth metal in the used fluid is strontium, the alkali used to neutralize excess acid is preferably strontium hydroxide or strontium oxide.

If the electrolyte to be restored is an alkali metal salt, the alkali used to neutralize excess acid can be an alkali metal hydroxide. Where sodium is the alkali metal, the alkali used to neutralize excess acid is sodium hydroxide. Where the electrolyte that is to be restored is a base metal salt, the alkali used to neutralize excess acid can be a base metal oxide. In this case, when a base metal is used to neutralize excess acid, measures should be taken to vent the hydrogen gas that is emitted from the process. Depending on the composition of the used halide fluid to be regenerated, the base metal oxide is selected from a group consisting of zinc oxide, copper oxide, cobalt oxide, cadmium oxide or nickel oxide. Alternatively, the alkali used to neutralize excess acid is a base metal hydroxide. The base metal hydroxide can be selected from a group of base metals consisting of zinc, copper, cobalt, cadmium or nickel. In an alternative embodiment, the alkali used to neutralize excess acid is ammonia In one specific embodiment of the method of this invention, the alkali (20) is a base metal or a base metal oxide, the reducing agent (30) is p-formaldehyde, the halogen (40) is bromine and the acid (50) used during the method is hydrobromic acid. In another embodiment of the method of this invention, the alkali is lime, the reducing agent is ammonia, the halogen is bromine and the acid is hydrobromic acid. Ammonia is one preferred reducing agent in an alkali and alkali earth metal systems and p-formaldehyde is the preferred reducing agent in a base metal system.

The equipment used to perform the method of this invention can be straightforward and quite simple. Basically, a reaction tank or pipe, one or more pumps and storage tanks are required. In one aspect of the method of this invention, the steps performed during the method are performed in a mixed reactor, preferably a stirred reactor or a tube reactor 10. In one embodiment, the recuperated used halide fluid is piped into the reactor 10 along with the bromine, acid 50, reducing agent 30 and alkali 20 so that the various chemical solutions are combined in the influent pipe and then mixed in the reactor 10. Alternatively, the influent chemical solutions can be piped in separately. In another preferred embodiment, the base metals used to enhance the electrolytes can be placed in a reactor along with used halide fluid. Bromine, acid, a reducing agent and alkali can then be piped into the reactor either separately or together in one pipeline.

Meters can be strategically placed along the influent pipeline and effluent pipeline to monitor the properties of the solutions: oxidation-reduction potential (ORP), pH and density. Alternatively, the properties can be measured manually. In one embodiment, the meters comprise an ORP meter, a pH meter and a density meter. In one preferred method of this invention, the chemical reaction is continued and the effluent product returned to the reactor until the desired levels of density, oxidation-reduction potential and pH are achieved. The reaction process can be carried on as a batch process or a continuous process.

In one aspect, a cooler 100 is used to maintain the lower temperatures. Separation of the resulting fluid from any suspended solid can be performed by several known methods. A gravity settler 90 is one. Alternatively, separation of the resulting fluid from any suspended solid is performed in a clarifer. A centrifuge or pressure filter or vacuum filter can also be used to separate solids from the resulting product, independently or as a subsequent process to a clarifier.

EXAMPLE 1

A 500 ml sample of a recovered completion fluid from an oil well with density of 15.98 lb/gallon and iron content of 540 mg/kg was placed in a glass beaker and kept stirred using an electrically driven stirrer. To this 10 ml of liquid bromine was introduced. Using a hot plate the temperature of the reaction fluid was raised to 148° F. (64.4° C.). The solution was kept stirred at this temperature for 1 hour, which was followed by addition of 2.9 g of p-formaldehyde as the reducing agent. Zinc oxide was added on an as-required basis to neutralize the excess acid of the fluid. The final fluid was filtered and analyzed for density and iron content, which respectively were determined to be 17.91 lb/gallon and 35 mg/kg.

EXAMPLE 2

A 500 ml sample of a recovered completion fluid from an oil well of Example 1 was placed in a glass beaker and kept stirred using a electrically driven stirrer. To this 20 ml of liquid bromine was introduced, while using a hot plate the temperature of the reaction solution was raised to 102° F. (38.9° C.). The reaction fluid was kept stirred at this temperature for 1 hour, which was followed by addition of 5.9 g of p-formaldehyde as the reducing agent. Zinc oxide was added on an as-required basis to neutralize the excess acidity of the reaction fluid. The final fluid was filtered and analyzed. The iron content of the final fluid was determined to be 40 mg/kg.

EXAMPLE 3

This test was conducted on a 500 ml sample of the same fluid as described in Example 1. In this case, 10 ml of liquid bromine was introduced to the fluid-, while it was kept stirred and using a hot plate the temperature of the reaction solution was raised to 80° F. (26.7° C.). The reaction fluid was kept stirred at this temperature for 1 hour, which was followed by addition of 13 g of metallic zinc as the reducing agent. In this test no basic material was added for the neutralization of excess acid. The final fluid was filtered and analyzed. The density and iron content of the final product were determined to be 19.95 lb/gallon and 32 mg/kg, respectively.

EXAMPLE 4

500 ml of a recovered drill-in fluid from an oil well, that contained polymer and solid material such as calcium carbonate, with density of 12.9 lb/gallon and iron content of 115.3 mg/kg was placed in a glass beaker and kept stirred using an electrically driven stirrer. To this, 20 ml of liquid bromine was introduced, while using a hot plate the temperature of the reaction fluid was raised to 160° F. (71.1° C.). The reaction fluid was kept stirred at this temperature for 1 hour, which was followed by addition of 29 ml of formalin (37% formaldehyde solution in water stabilized with 12–14% methanol). The excess acid generated in the reaction was neutralized by the addition of lime on required basis (29 g). The final reaction fluid was filtered and analyzed. The density and iron content of the filtered fluid were measured to be 13.3 lb/gallon and 14 mg/kg, respectively.

EXAMPLE 5

On a 500 ml sample of the same fluid that was used in Example 4 test was conducted. In this case, while the liquid bromine addition was maintained at 20 ml, the reaction suspension was heated to about 180° F. (82.2° C.) for 1.7 hrs. 5.9 g of p-formaldehyde was used as the reducing agent. Similar to Example 4, lime was used for the neutralization of excess acid content. The final reaction fluid was filtered and analyzed. The density and iron content were determined to be 13.4 lb/gallon and 10 mg/kg, respectively.

EXAMPLE 6

500 ml sample of a drill-in fluid recovered from an oil well with density of 15.81 lb/gallon and iron content of 105 mg/kg was placed in a glass beaker and kept stirred with an electrically driven stirrer. To this 10 ml of liquid bromine was introduced and the temperature of the reaction fluid was raised and maintained at 152° F. (66.7° C.) for 1 hour using a hot plate. 12.8 g of metallic zinc was added as the reducing agent. In this case, no base was added for the neutralization of excess acid that was generated during the course of reaction. The final reaction suspension was filtered and analyzed. The density and iron content were measured to be 15.95 lb/gallon and 38 mg/kg, respectively.

EXAMPLE 7

On a 500 ml of the same fluid that was used in Example 6, the addition of liquid bromine in this test was increased to 30 ml. The temperature of the reaction fluid was maintained at 150° F. (65.6° C.) for 0.5 hour. In this case, 8.8 g of p-formaldehyde was added as the reducing agent, while lime was used for the neutralization of excess acid content of the reaction. The density and iron content of the final filtered fluid were measured to be 16.13 lb/gallon and 42 mg/kg, respectively.

EXAMPLE 8

Test described in Example 7 was repeated, while in this case zinc oxide was used for the neutralization of excess acid, replacing lime of Example 7. The density and iron content of the final filtered fluid were measured to be 16.08 lb/gallon and 44 mg/kg, respectively.

The foregoing description is illustrative and explanatory of preferred embodiments of the invention, and variations in the size, shape, materials and other details will become apparent to those skilled in the art. It is intended that all such variations and modifications which fall within the scope or spirit of the appended claims be embraced thereby.

What is claimed is:

1. A method for regeneration of used halide fluids comprising soluble and insoluble impurities and having a density greater than 9.0 lbs./gal, the method comprising:

a) adding acid to the used halide fluid;

b) contacting the used halide fluid with halogen to increase fluid density, adjust the true crystallization temperature and oxidize impurities;

c) adding a reducing agent while maintaining the temperature at a minimum of 10° C.;

d) contacting the fluid with an alkali to neutralize excess acid;

e) separating any suspended solid impurities from the fluid.

2. The method of claim 1 wherein the pH maintained during the method is within a range of approximately 0 to 10.0.

3. The method of claim 1 wherein the acid added in step 1 comprises hydrobromic acid.

4. The method of claim 1 wherein the acid added in step 1 comprises hydrochloric acid.

5. The method of claim 1 wherein the acid added in step 1 comprises an organic acid.

6. The method of claim 1 wherein the reducing agent is selected from a group consisting of ammonia, sulfur, hydrogen sulfide, sodium bisulfide, metallic zinc, metallic iron, metallic copper, metallic nickel, metallic cadmium, metallic cobalt, metallic aluminum, metallic manganese, metallic chromium, organic acids, alcohols and aldehydes.

7. The method of claim 1 wherein the used fluid comprises an alkali earth metal.

8. The method of claim 7 wherein the alkali earth metal is calcium and the alkali used to neutralize excess acid is calcium hydroxide.

9. The method of claim 7 wherein the alkali earth metal present in the used fluid is calcium and the alkali used to neutralize excess acid is calcium oxide.

10. The method of claim 7 wherein the alkali earth metal present in the used fluid is strontium and the alkali used to neutralize excess acid is strontium hydroxide.

11. The method of claim 7 wherein the alkali earth metal present in the used fluid is strontium and the alkali used to neutralize excess acid is strontium oxide.

12. The method of claim 1 wherein the alkali used to neutralize excess acid is an alkali metal hydroxide.

13. The method of claim 12 wherein the alkali used to neutralize excess acid is sodium hydroxide.

14. The method of claim 1 wherein the used halide fluid comprises a base metal and the alkali used to neutralize excess acid is a base metal oxide.

15. The method of claim 14 wherein base metal oxide is selected from a group consisting of zinc oxide, copper oxide, cobalt oxide, cadmium oxide and nickel oxide.

16. The method of claim 1 wherein the used halide fluid comprises a base metal and the alkali used to neutralize excess acid is a base metal hydroxide.

17. The method of claim 16 wherein base metal hydroxide is selected from a group of base metal hydroxides consisting of zinc hydroxide, copper hydroxide, cobalt hydroxide, cadmium hydroxide and nickel hydroxide.

18. The method of claim 1 wherein a base metal is used to neutralize excess acid.

19. The method of claim 1 wherein the alkali used to neutralize excess acid is ammonia.

20. The method of claim 1 wherein steps a–d are performed in a mixed reactor.

21. The method of claim 1 wherein separation of the resulting fluid from any suspended solid is performed in a gravity settler.

22. The method of claim 1 wherein separation of the resulting fluid from any suspended solid is performed in a clarifer.

23. The method of claim 1 wherein separation of the resulting fluid from any suspended solid is performed in a centrifuge.

24. The method of claim 1 wherein separation of the resulting fluid from any suspended solid is performed in a pressure filter.

25. The method of claim 1 wherein a defoaming agent is used to control excessive foaming in the reaction vessel.

26. A method for regeneration of used base metal halide fluids having a density greater than 9.0 lbs./gal. and containing soluble and insoluble impurities, the method comprising:

a) adding acid to the used halide so that the pH is within a range of approximately 0 to 5.5;

b) contacting the used halide fluid with halogen to increase the density to at least 10.0 lbs./gal., adjust the true crystallization temperature and oxidize impurities;

c) adding a reducing agent while maintaining the temperature at a minimum of 10° C.;

d) contacting the fluid with an base metal oxide to neutralize excess acid;

e) separating any suspended solid impurities from the fluid.

27. The method of claim 26 wherein the reducing agent is selected from a group consisting of anhydrous ammonia, sulfur, hydrogen sulfide, sodium bisulfide, metallic zinc, metallic iron, metallic copper, metallic nickel, metallic cadmium, metallic cobalt, metallic aluminum, metallic manganese, metallic chromium, organic acids, alcohols and aldehydes.

28. A method for regeneration of used alkali earth metal halide fluids having a density greater than 9.0 lbs./gal. and containing soluble and insoluble impurities, the method comprising:

a) adding acid to the used halide so that the pH is within a range of approximately 0 to 10.0;

b) contacting the used halide fluid with halogen to increase the density to at least 10.0 lbs./gal., adjust the true crystallization temperature and oxidize impurities;

c) adding a reducing agent while maintaining the temperature at a minimum of 10° C.;

d) contacting the fluid with an alkali earth metal oxide to neutralize excess acid;

e) separating any suspended solid impurities from the fluid.

29. A method for regeneration of a used halide fluid comprising a blend of calcium halide and zinc halide having a density greater than 9.0 lbs./gal, the fluid containing soluble and insoluble impurities, the method comprising:

a) adding acid to the used halide fluid so that the pH is within a range of approximately 0 to 10;

b) contacting the blend of used halide fluid with bromine to increase the density to at least 10.0 lbs./gal. and oxidize soluble impurities;

c) adding a reducing agent while maintaining the temperature at a minimum of 10° C.;

d) contacting the fluid with an alkali to neutralize excess acid;

e) separating any suspended solid impurities from the fluid.

30. A method for regeneration of used halide fluids comprising soluble and insoluble impurities, the method comprising:

a) determining density of the used halide fluid;

b) analyzing chemical composition and solids content of the used halide fluid;

c) removing solids content from the used halide fluid;

d) adding acid to the used halide fluid;

e) contacting the used halide fluid with bromine to increase fluid density to at least 10.0 lbs./gal., adjust true crystallization temperature and oxidize impurities;

f) adding a reducing agent while maintaining the temperature at a minimum of 10° C.;

g) contacting the fluid with an alkali to neutralize excess acid;

h) separating any suspended solid impurities from the fluid.

31. A method for regeneration of used halide fluids comprising soluble and insoluble impurities and having a density greater than 9.0 lbs./gal, the method comprising:

a) adding acid to the used halide fluid;

b) contacting the used halide fluid with a halogen-generating species to increase fluid density, adjust the true crystallization temperature and oxidize impurities;

c) adding a reducing agent while maintaining the temperature at a minimum of 10° C.;

d) contacting the fluid with an alkali to neutralize excess acid;

e) separating any suspended solid impurities from the fluid.

32. The method of claim 31 wherein the pH maintained during the method is within a range of approximately 2.0 to 5.5.

33. The method of claim 31 wherein the pH maintained during the method is within a range of approximately 0 to 10.

34. The method of claim 31 wherein the acid added in step 1 is selected from a group consisting of hydrobromic acid, hydrochloric acid and an organic acid.

35. The method of claim 31 wherein the reducing agent is selected from a group consisting of ammonia, sulfur, hydrogen sulfide, sodium bisulfide, metallic zinc, metallic iron, metallic copper, metallic nickel, metallic cadmium, metallic cobalt, metallic aluminum, metallic manganese, metallic chromium, organic acids, alcohols and aldehydes.

36. The method of claim 31 wherein the used halide fluid comprises calcium and the alkali used to neutralize excess acid is selected from a group consisting of calcium hydroxide and calcium oxide.

37. The method of claim 31 wherein the alkali used to neutralize excess acid is an alkali metal wherein the used halide fluid comprises a base metal and the alkali used to neutralize excess acid is a base metal oxide selected from a group consisting of zinc oxide, copper oxide, cobalt oxide, cadmium oxide and nickel oxide.

38. The method of claim 31 wherein the used halide fluid comprises a base metal and the alkali used to neutralize excess acid is a base metal hydroxide selected from a group of base metal hydroxides consisting of zinc hydroxide, copper hydroxide, cobalt hydroxide, cadmium hydroxide and nickel hydroxide.

39. The method of claim 31 wherein the alkali used to neutralize excess acid is ammonia.

40. A method for regeneration of used halide fluids comprising soluble and insoluble impurities and having a density greater than 9.0 lbs./gal, the method comprising:

a) adding acid to the used halide fluid;

b) contacting the used halide fluid with halogen to increase fluid density, adjust true crystallization temperature and oxidize impurities;

c) adding a reducing agent while maintaining the temperature of the fluid above the true crystallization temperature of electrolytes within fluid;

d) contacting the fluid with an alkali to neutralize excess acid;

e) separating any suspended solid impurities from the fluid.

41. A method for regeneration of used halide fluids comprising soluble and insoluble impurities, the method comprising:

a) determining density of the used halide fluid, determining the true crystallization temperature;

b) analyzing chemical composition and solids, polymers, oil and grease content of the used halide fluid;

c) removing solids, oil and grease content from the used halide fluid;

d) adding acid to the used halide fluid;

e) contacting the used halide fluid with bromine to increase fluid density, adjust the true crystallization temperature and oxidize impurities;

f) adding a reducing agent while maintaining the temperature at a minimum of 10° C.;

g) contacting the fluid with an alkali to neutralize excess acid;

h) separating any suspended solid impurities from the fluid.

42. A method for regeneration of used halide fluids comprising soluble and insoluble impurities, the method comprising:

a) determining density of the used halide fluid;

b) analyzing chemical composition and solids, polymers, oil and grease content of the used halide fluid;

c) removing solids, oil and grease content from the used halide fluid d) adding acid to the used halide fluid;

e) contacting the used halide fluid with a bromine-generating species to increase fluid density, adjust the true crystallization temperature and oxidize impurities;

f) adding a reducing agent while maintaining the temperature at a minimum of 10° C.;

g) contacting the fluid with an alkali to neutralize excess acid;

h) separating any suspended solid impurities from the fluid.

43. A method for regeneration of used halide fluids comprising soluble and insoluble impurities, the method comprising:

a) determining density of the used halide fluid;

b) analyzing chemical composition and solids content of the used halide fluid;

c) removing solids content from the used halide fluid;

d) adding an acid to the used halide fluid, the acid selected from a group consisting of hydrobromic acid, hydrochloric acid and organic acid;

e) contacting the used halide fluid with bromine to increase fluid density, adjust true crystallization temperature and oxidize impurities;

f) adding a p-formaldehyde while maintaining the temperature at a minimum of 10° C.;

g) contacting the fluid with an alkali selected from a group consisting of base metal oxides, alkali earth metals oxides and base metals to neutralize excess acid;

h) separating any suspended solid impurities from the fluid.

44. A method for regeneration of used halide fluids comprising soluble an insoluble impurities, the method comprising:

a) determining density of the used halide fluid;

b) analyzing chemical composition and solids content of the used halide fluid;

c) removing of solids content from the used halide fluid;

d) adding an acid to the used halide fluid, the acid selected from a group consisting of hydrobromic acid, hydrochloric acid and organic acid;

e) contacting the used halide fluid with halogen-generating species to increase fluid density, adjust true crystallization temperature and oxidize impurities;

f) adding a p-formaldehyde while maintaining the temperature at a minimum of 10° C.;

g) contacting the fluid with an alkali selected from a group consisting of base metal oxides, alkali earth metals oxides and base metals to neutralize excess acid;

h) separating any suspended solid impurities from the fluid.

45. A method for regeneration of used halide fluids comprising soluble and insoluble impurities, the method comprising:

a) determining density of the used halide fluid;

b) analyzing chemical composition and solids content of the used halide fluid;

c) removing of solids content from the used halide fluid;

d) adding an acid to the used halide fluid, the acid selected from a group consisting of hydrobromic acid, hydrochloric acid and organic acid;

e) contacting the used halide fluid with bromine-generating species to increase fluid density, adjust true crystallization temperature and oxidize impurities;

f) adding a p-formaldehyde while maintaining the temperature at a minimum of 10° C.;

g) contacting the fluid with an alkali selected from a group consisting of base metal oxides, alkali earth metals oxides and base metals to neutralize excess acid;

h) separating any suspended solid impurities from the fluid.

46. A method for regeneration of used halide fluids comprising soluble and insoluble impurities, the method comprising:

a) determining density of the used halide fluid;

b) analyzing chemical composition and solids content of the used halide fluid;

c) removing solids content from the used halide fluid;

d) contacting the used halide fluid with a halogen to increase fluid density to at least 10.0 lbs./gal., adjust true crystallization temperature and oxidize impurities;

e) adding a reducing agent while maintaining the temperature at a minimum of 10° C.;

f) contacting the fluid with an alkali to neutralize excess acid;

g) separating any suspended solid impurities from the fluid.

* * * * *